United States Patent [19]

Laprade et al.

[11] 4,000,226

[45] Dec. 28, 1976

[54] CARBURETTOR FOR AN INTERNAL COMBUSTION ENGINE

[75] Inventors: Bernard R. Laprade; Xavier J. Laprade, both of Arudy; Pierre J. Gele, Laloubere, all of France

[73] Assignees: Societe Nationale des Petroles d'Aquitaine, Courbevoie; Les Usines Laprade, Arudy, both of France

[22] Filed: Jan. 24, 1975

[21] Appl. No.: 543,790

[30] Foreign Application Priority Data

Jan. 30, 1974 France ..... 74.03008

[52] U.S. Cl. ..... 261/50 A; 261/DIG. 74; 92/48; 92/63; 92/64

[51] Int. Cl.[2] ..... F02M 7/22

[58] Field of Search ..... 261/50 A, 44 R, DIG. 74, 261/52, DIG. 19; 92/48, 63, 64

[56] References Cited

UNITED STATES PATENTS

| | | | |
|---|---|---|---|
| 2,680,605 | 6/1954 | Bracke | 261/DIG. 19 |
| 2,933,168 | 4/1960 | Leibing et al. | 261/DIG. 19 |
| 3,243,167 | 3/1966 | Winkler | 261/50 A |
| 3,272,488 | 9/1966 | Bickhaus | 261/50 A |
| 3,307,837 | 3/1967 | Winkler | 261/50 A |
| 3,322,408 | 5/1967 | Stoltman | 261/50 A |
| 3,333,832 | 8/1967 | O'Neill | 261/50 A |
| 3,346,245 | 10/1967 | Mennesson | 261/69 R |
| 3,437,081 | 4/1969 | Mennesson | 261/69 R |
| 3,721,428 | 3/1973 | Gele et al. | 261/50 A |
| 3,869,528 | 3/1975 | Mick | 261/50 A |

FOREIGN PATENTS OR APPLICATIONS

| | | | |
|---|---|---|---|
| 1,281,746 | 6/1964 | Germany | 261/50 A |

*Primary Examiner*—Tim R. Miles
*Attorney, Agent, or Firm*—Finnegan, Henderson, Farabow & Garrett

[57] ABSTRACT

A carburettor for an internal combustion engine includes a chamber into which fuel is introduced from a metering valve to produce a fuel/air mixture in the chamber. A main valve controls the rate of flow of fuel/air mixture from the chamber and a further valve upstream of the main valve is provided the opening of which controls the opening of the metering valve. The further valve opens so as to keep the pressure between the main and further valve constant with changes in flow rate through the chamber. Means are provided to provide an indication of the pressure of fuel/air mixture downstream of the main valve such that the metering valve can be further opened as a function of changes in said pressure downstream of the main valve.

10 Claims, 5 Drawing Figures

2
18
3
4
5
15
14
13
+
10
11
6
7
1
12
8
9

18
13
+
4
15
14
16
1
17

CARBURETTOR FOR AN INTERNAL COMBUSTION ENGINE

FIELD OF THE INVENTION

This invention relates to a carburettor for an internal combustion engine, the carburettor in use having a substantially constant reduced pressure therein.

BACKGROUND TO THE INVENTION

In carburettors which operate under a constant reduced pressure, it is known to provide a chamber including a main flap, on which an accelerator pedal acts, and a secondary flap which is situated in the chamber upstream of the main flap and which is biassed towards its closed position by a force which is proportional to the flow rate of air through the chamber, such that a reduced pressure is produced between the two flaps which remains practically constant. The secondary flap controls a needle-valve which controls the flow rate of fuel into the chamber, the fuel entering the chamber between the two flaps so as to control the fuel/air mixture produced in the chamber since the degree of opening of the secondary flap is a function of the air flow rate, the metering needle of said valve, which is connected mechanically to the said flap, also occupies a position defined by the rate of air flow into the carburettor.

However, the required fuel/air mixture varies in dependence upon the speed and the load of the engine and consequently one and the same air flow rate can correspond to very different running conditions. For example, the air flow rate will be the same at 1,500 revolutions/minute and full load as at 3,000 revolutions/minute and half load or 6,000 revolutions/minute and quarter load. Thus, the most suitable rate of metering fuel varies with these different running conditions.

If the profile of the needle in the needle valve is arranged to provide metering (depending on the shift of the main flap under the effect of the air flow rate), which results in a very low carbon monoxide CO content in exhaust gasses from the engine for all partial loads of the engine and for all speeds less than 4,000 revolutions/minute, the engine runs rather unsatisfactorily under conditions of acceleration and under full load conditions due to a weak mixture.

SUMMARY OF THE INVENTION

It is an object of the invention to provide a carburettor for an internal combustion engine in which, at partial loads of the engine, the metering of fuel is controlled by the position of the secondary flap in accordance with the rate of air flow through the carburettor but in which at high loads of the engine, the metering of fuel is increased to maintain optimum performance of the engine.

The invention provides a carburettor for an internal combustion engine comprising a chamber having an air inlet and an outlet, a tube for introducing fuel into said chamber to produce a fuel/air mixture in the chamber, a metering valve for controlling the rate of supply of fuel to said tube, a main valve in said chamber for controlling the rate at which said fuel/air mixture is fed to said outlet, a further valve upstream of said tube, means responsive to the rate of flow of air from the inlet past said further valve for controlling the opening of said further valve so as to maintain the pressure of the fuel/air mixture between said valves substantially constant, a linkage connected to said further valve and said metering valve controlling the rate of flow of fuel to said chamber in accordance with the opening of said further valve, a sensor responsive to the pressure of the fuel/air mixture downstream of said main valve, and operative means responsive to said sensor for opening said needle valve in a manner which is a function of the pressure of said fuel/air mixture downstream of the main valve.

BRIEF DESCRIPTION OF DRAWINGS

In order that the invention may be more fully understood several embodiments thereof will now be described by way of illustration with reference to the accompanying drawings in which.

DETAILED DESCRIPTION OF PREFERRED EMBODIMENTS

Figure 1:
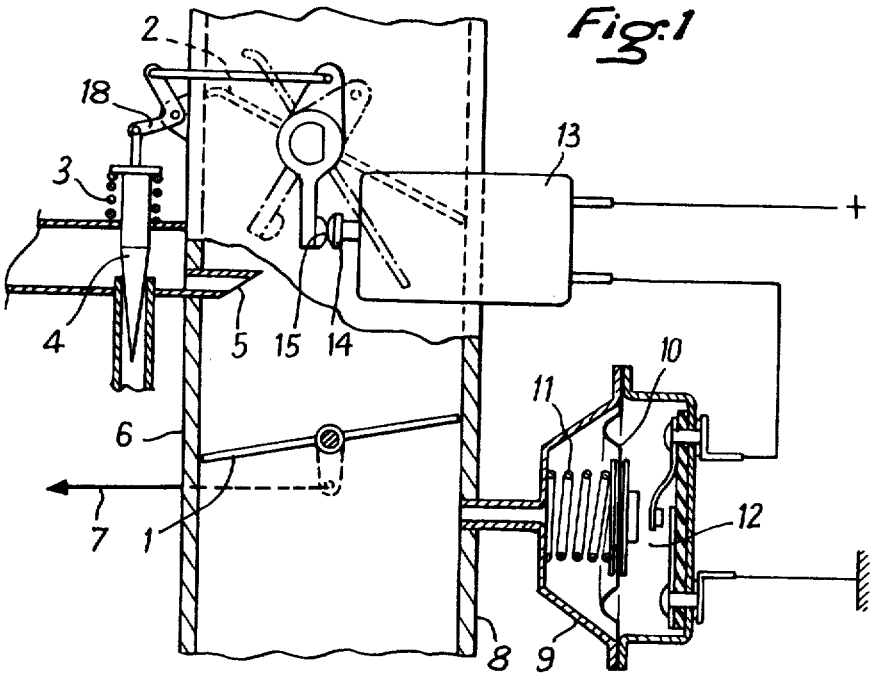
FIG. 1 is a diagrammatic view in section of a carburettor according to the invention.

Referring to FIG. 1, the carburettor includes a main flap 1 actuated by an accelerator pedal at 7, and a secondary flap 2, which in this example is an eccentric flap that is biassed to close an inlet to chamber 6 by means of a compression spring 3 and a linkage 18. The flap 2 controls movement of a needle 4 in a needle valve which meters the fuel discharging at 5 into the chamber 6 of the carburettor; movement of the flap 2 being transmitted by linkage 18 to needle 4.

This carburettor has, for each air flow rate, two rates of metering fuel into chamber 6, one rate being controlled in accordance with changes of the air flow rate through chamber 6, and the other rate being produced by a direct control of the metering needle 4 in response to an increase above a threshold valve of pressure in an outlet to the chamber 6 which comprises an inlet manifold 8 to the engine.

The increase in pressure is measured by a manostat 9 having a membrane 10 held in position by a spring 11. When the pressure increases above the threshold value, for example 100 g force/cm$^2$under atmospheric pressure, the spring 11 pushes back the membrane 10 which then acts on a contact 12 which switches electrical power to an electromagnet 13. The plunger or core 14 of the electromagnet moves to the left and pushes back a lever 15 attached to the flap 2 so as to move the flap and lever to the position shown in notched lines.

Consequently, when the given threshold of reduced pressure is reached, the flap 2 and the needle 4 open suddenly from the value determined by the air flow rate, to produce an enriching of the mixture for optimum operation of the engine at full load.

Figure 2:
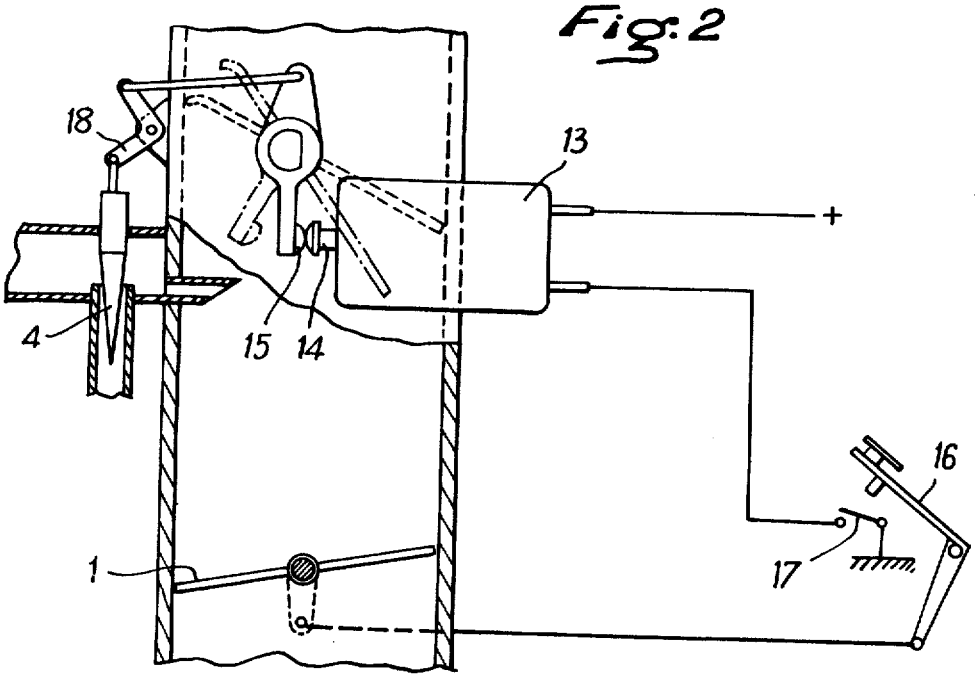
FIG. 2 is a variant of the carburettor of FIG. 1.

In the variant of the carburettor shown in FIG. 2, the electromagnet 13 is actuated by an accelerator pedal 16 which, at maximum travel, closes the switch 17. The position of the pedal 16 corresponding to closure of the switch 17 will be chosen to correspond to the threshold value chosen for the reduced pressure in the inlet manifold: for wide opening of the main flap 1, this correspondence is sufficiently precise.

Figure 3:
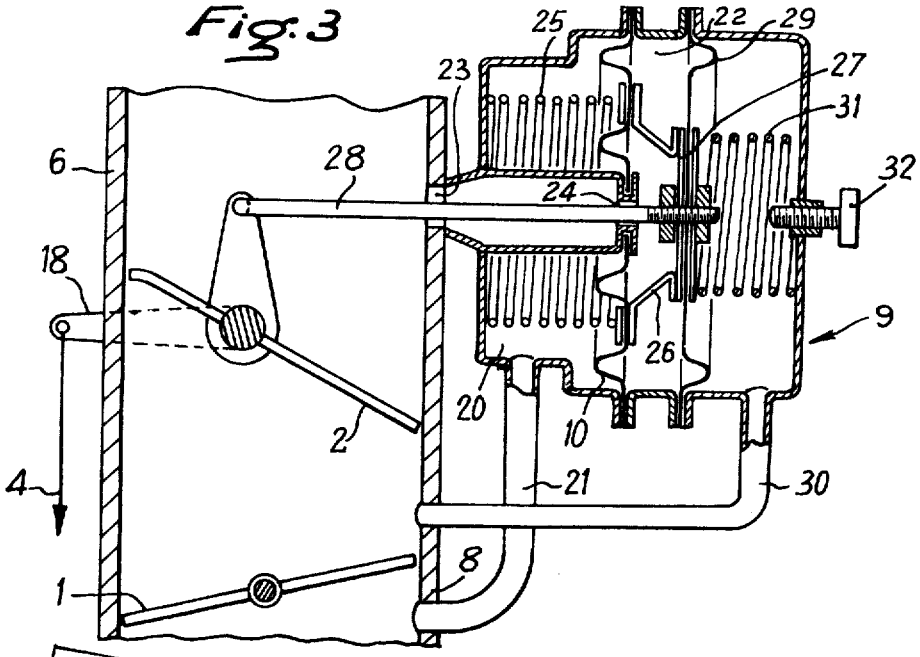
FIGS. 3 and 4 are illustrations of two further embodiments of carburettors according to the invention.

In the example of the carburettor shown in FIG. 3, a pneumatic means consisting of the membrane 10 of a manostat 9 is provided mechanically coupled to flap 2 to open the flap in response to an increase in pressure in manifold 8. The membrane 10 is coupled to the needle 4 and the flap 2 by stops 26 which abut a disc 27 attached to rod 28. The membrane 10 is subject on one side thereof at 20 to the pressure in the inlet manifold 8, transmitted via the pipe 21, and on the other side thereof at 22 to the pressure prevailing upstream of the flaps 2 transmitted through the passages 23 and 24. The membrane 10 is supported by a spring 25.

During operation of the engine at partial load, the pressure is less than the threshold, and the membrane 10 is drawn towards the left in opposition to the spring 25 so as to draw stops 26 away from disc 27 mounted at the end of the rod 28. The flap 2 and the needle 4 thus open in proportion to the air flow rate in accordance with the position of a further membrane 29 described in detail hereinafter.

If the pressure in between the flaps 1 and 2 increases above the given value, the membrane 10 is pushed back towards the right and the stops 26 come into contact with the disc 27 causing the flap 2 and the needle 4 to open.

The manostat 9 also includes a membrane 29 for controlling the position of flap 2 to maintain the reduced pressure between the flaps 1 and 2 substantially constant. The membrane 29 is held in position by a spring 31 which on the rod 28, and membrane 29 is subject on the one side to the pressure upstream of the flap 2 and on the other side to the pressure between the flaps 1 and 2 through a conduit 30.

A stop 32 defines the maximum permissible opening of the flap 2 and the stop is preferably adjustable.

Figure 4:
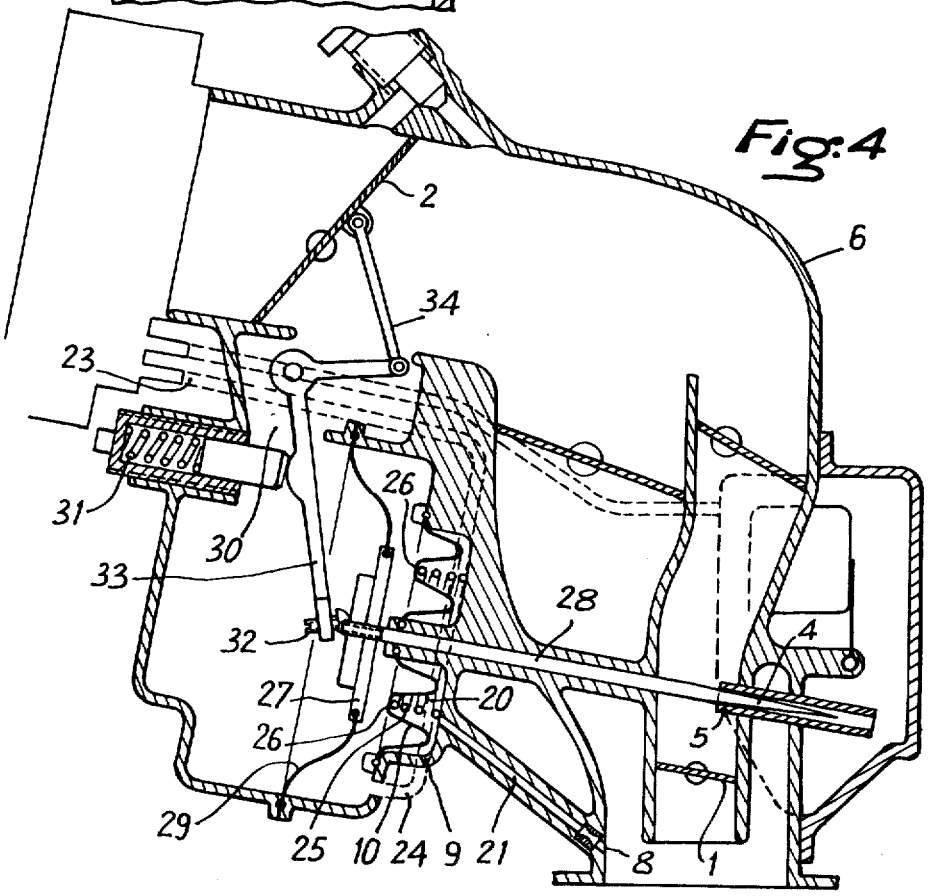

FIG. 4 illustrates an embodiment of the invention which comprises a twin choke carburettor that operates to provide a constant reduced pressure therein of the type described in an application for a French Patent filed on June 29, 1973 under No. 73/23,919.

In this Figure, the like components to those in FIG. 3 are marked with the same reference numbers, and the method of operation is the same: at partial engine loads, the membrane 10 is drawn towards the right in opposition to the spring 25, and the stops 26 do not touch the disc 27 mounted at the end of the rod 28 which actuates the needle 4 under the control of the flap 2. The flap 2 and the needle 4 thus open in proportion to the air flow rate.

If the pressure in the manifold increases above the threshold value i.e., when engine is operating under full load, the membrane 10 is pushed back towards the left, and the stops 26 come into contact with the disc 27 which causes the flap 2 and the needle 4 to open.

This assembly is combined with a regulating or equilibrating membrane 29 held in position by the spring 31 which acts on the rod 28 via levers 33 and 34. This membrane 29 is subject on the one hand to the pressure prevailing upstream from the carburettor, via the channel 24, 23, and on the other hand to the pressure prevailing between the flaps 1 and 2, via the passage 30. The disc 27 is supported by the membrane 29 and the adjustable stop 32 defines the maximum opening chosen for the flap 2 when the membrane 10 comes into action.

Figure 5:
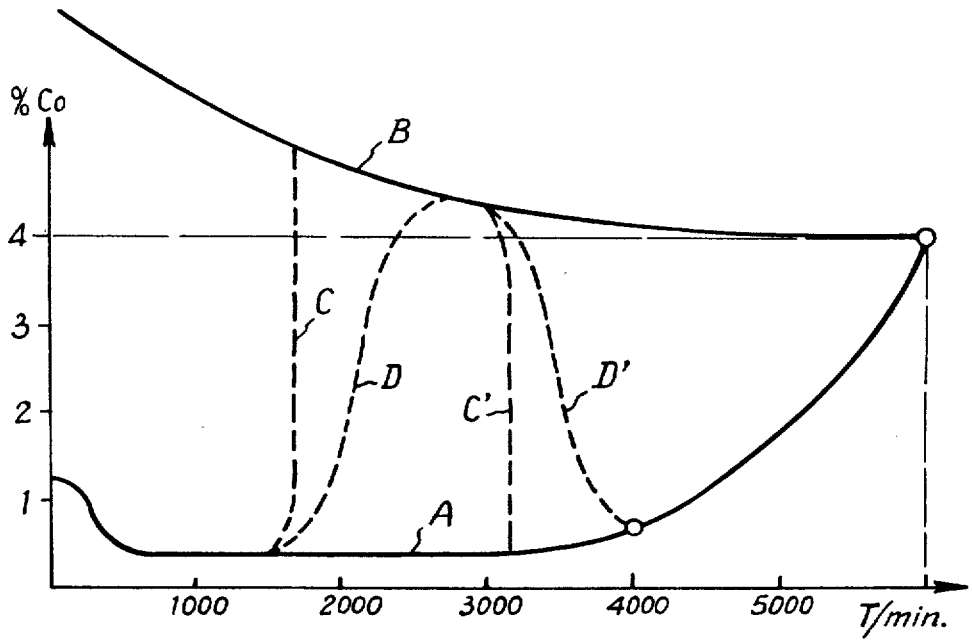
FIG. 5 illustrates the metering curves obtained from the carburettors.

FIG. 5 illustrates the operation of a carburettor according to the invention. The %CO content of the exhaust gases, taken as being representative of the petrol flow rate relative to the air flow rate, is plotted as the ordinate, and the speed of the engine in revolutions/minute (T/min) is plotted as the abscissa.

The curve A is a curve of the desired fuel flow rate when a vehicle driven by the engine is used at a constant speed i.e., partial engine loads.

The curve B is the curve of full throttle fuel flow rate as a function of the engine speed.

It is seen that the curve A comprises an enriching for idling and begins to rejoin the curve B from approximately 4,000 revolutions/minute upwards, which is the maximum speed considered in relation to pollution problems. Beyond this speed, the mixture is necessarily enriched in order to achieve the maximum speed (6,000 revolutions/minute in this example) with full throttle metering.

The profile of the needle 4 is designed to provide the desired shape curve A. However, when (no matter what the engine speed may be) the pressure in the inlet manifold falls below the chosen threshold value (e.g. re-starting, climbing and accelerating), the mixture is enriched and the fuel flow rate of the mixture follows a curve such as C for the devices of FIGS. 1, 2 and 3, or curve D for the devices of FIGS. 3 and 4, and rejoins the curve B.

When the reduced pressure in the inlet manifold again exceeds the threshold value chosen, the metering passes again from the curve B to the curve A following a graph such as C′ or D′.

It is seen that the carburettor according to the invention thus makes it possible to obtain two different fuel meterings, namely an anti-pollution metering to reduce CO exhaust emission (curve A) and a full load metering which can be used no matter what the speed may be (curve B).

100 g has been indicated as the threshold value which can be used for changing from the curve A to the curve B. In practice, this threshold value can be between 100 g and 250 g and it is preferably adjustable.

The amplitude of the action of the stop 14 or of the rod 28 will be chosen so as to provide operation under full throttle conditions no matter what the speed may be, that is to say a curve B close to the horizontal.

The full throttle metering (curve B) is defined by the requirement of the engine to provide the maximum power. Because of the heterogeneity of the mixture, this corresponds to an amount of fuel which is slightly greater than that theoretically necessary to use all the air (the maximum power being in fact obtained only when all the oxygen is used up). Experience shows that to achieve maximum power approximately 15% more than the theoretical amount of fuel is required. The opening of the flap 2 corresponding to this power is determined by the flow rate of air passing the flap and by the size of the flap. Full opening of flap 2 is preferably avoided because, in this case, the sensitivity of the flap to changes in the flow rate of air becomes zero, and preferably the maximum opening angle of the flap, at the maximum air flow rate, is approximately 75° to 85° relative to the axis of the carburettor. The opening of the flap 2 under the effect of the direct control of FIGS. 1, 3 and 4 can be of the same order of magnitude or a little less than the maximum opening.

One of the advantages of the invention is to make it possible to dispense with an accelerator pump for increasing the fuel flow rate during acceleration of the engine.

We claim:

1. A carburettor for an internal combustion engine comprising:

a. a chamber having an air inlet and an outlet;

b. a tube connected to said chamber for introducing fuel into said chamber and thereby producing a fuel/air mixture in said chamber;

c. a metering valve for controlling the rate of flow of fuel from said tube to said chamber;

d. a throttle valve located in said chamber downstream of said tube for controlling the rate of the fuel/air mixture fed to said outlet;

e. a secondary valve located in said chamber upstream of said tube;

f. first linkage means connecting said secondary valve to said metering valve for controlling the rate of flow of fuel to said chamber in accordance with the movement of said secondary valve;

g. pneumatic means for maintaining a substantially constant reduced pressure of the fuel/air mixture between said secondary valve and said throttle valve, controlling the movement of said secondary valve in response to the rate of flow of air from said air inlet past said secondary valve, and for controlling the movement of said secondary valve as a function of pressure change of the fuel/air mixture downstream of said throttle valve, said pneumatic controlling means including:

i. a housing;

ii. a first pressure-sensitive membrane mounted in said housing and subjected to pressures between said secondary and throttle valves and upstream of said secondary valve;

iii. a second pressure-sensitive membrane mounted in said housing and subjected to pressures upstream of said secondary valve and downstream of said throttle valve;

iv. a first pressure conduit having one end opening into said chamber between said secondary valve and said throttle valve, and the other end opening into said housing on one side of said first membrane;

v. a second pressure conduit having one end opening into said chamber upstream of said secondary valve and the other end opening into said housing on the other side of said first membrane and one side of said second membrane;

vi. second linkage means connecting said first membrane to said secondary valve for controlling the movement of said secondary valve as a function of the movement of said first membrane;

vii. a third pressure conduit having one end opening into said chamber downstream of said throttle valve and the other end opening into said housing on the other side of said second membrane; and viii. stop means for transmitting movement of said second membrane to said second linkage means, said second linkage means thereby further controlling movement of said secondary valve as a function of the movement of said second membrane.

2. A carburettor according to claim 1 wherein said chamber includes a main duct from said air inlet to said outlet and a smaller auxiliary duct from said air inlet to said outlet, and wherein said tube opens into said auxiliary duct.

3. A carburettor according to claim 1 wherein said metering valve comprises a needle valve.

4. The carburettor as recited in claim 1 wherein said secondary valve is biased to a closed position by a force proportional to the rate of flow of air across said secondary valve.

5. The carburettor as recited in claim 1 wherein said first and second membranes form first, second and third pressure chambers in said housing, said first pressure chamber formed between said first and second membranes and connected to said second pressure conduit, said second pressure chamber formed between said housing and said second membrane and connected to said third pressure conduit, and said third pressure chamber formed between said housing and said first membrane and connected to said first pressure conduit.

6. The carburettor as recited in claim 5, wherein said stop means is attached to said second membrane and is positioned in said first pressure chamber for abutment against said first membrane.

7. The caburettor as recited in claim 6, wherein a first spring is positioned between said housing and said second membrane for supporting said second membrane, said stop means not abutting against said first membrane when said second membrane is drawn in opposition to said first spring during partial engine load.

8. The carburettor as recited in claim 7, wherein said pneumatic controlling means includes a stop for regulating movement of said second linkage means and for defining the maximum opening movement of said secondary valve.

9. The carburettor as recited in claim 7, wherein a second spring is positioned in said housing for supporting said first membrane.

10. A carburettor according to claim 1 wherein said throttle valve and said secondary valve each comprises a butterfly valve.

* * * * *